US006494741B2

(12) United States Patent
Handa et al.

(10) Patent No.: US 6,494,741 B2
(45) Date of Patent: Dec. 17, 2002

(54) MODULAR JACK

(75) Inventors: Shinsuke Handa, Osaka (JP); Satoru Watanabe, Osaka (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/994,616

(22) Filed: Nov. 28, 2001

(65) Prior Publication Data

US 2002/0065002 A1 May 30, 2002

(30) Foreign Application Priority Data

Nov. 28, 2000 (JP) ..... 2000-361384

(51) Int. Cl.[7] ..... H01R 13/58
(52) U.S. Cl. ..... 439/607; 439/676
(58) Field of Search ..... 439/607, 676, 439/608, 108, 110, 609, 610, 465, 466, 467

(56) References Cited

U.S. PATENT DOCUMENTS 5,162,000 A * 11/1992 Frantz ..... 439/607

6,162,089 A * 12/2000 Costello et al. ..... 439/541.5

OTHER PUBLICATIONS

Ser. No. 09/994,826, filed Nov. 28, 2001, pending.

Ser. No. 09/994,625, filed Nov. 28, 2001, pending.

* cited by examiner

*Primary Examiner*—Renee Luebke
*Assistant Examiner*—Phuong-Chi Nguyen
(74) *Attorney, Agent, or Firm*—Oblon, Spivak, McClelland, Maier & Neustadt, P.C.

(57) ABSTRACT

A casing includes an insertion recessed portion opened in a front direction via an insertion opening. A shell made of metal for electromagnetic shielding includes a front plate for covering a front face of the casing and side walls extended therefrom. In a state that a modular jack is attached to an apparatus, a portion of the shell exposed to an outer side of a cabinet of the apparatus is covered by an insulating cover. An insertion opening of a front plate of the insulating cover is smaller than an opening of the front plate of the shell.

6 Claims, 10 Drawing Sheets

MODULAR JACK

BACKGROUND OF THE INVENTION

1. Field of the Invention

The present invention relates to a modular jack mounted to an apparatus such as a notebook type personal computer, a game machine or the like and mated with a modular plug corresponding thereto.

2. Description of the Related Art

A modular jack of this kind is for connecting a modular plug from a telephone network or an LAN network and is provided with a casing made of synthetic resin having an insertion recessed portion for inserting and drawing a modular plug. At inside of the insertion recessed portion, there is contained a contact pin for being brought into contact with a contact of the modular plug.

Normally, a portion of the casing, particularly, a surrounding of an insertion opening communicating with the insertion recessed portion, is surrounded by a shell made of a metal to thereby achieve electromagnetic shielding for the contact pin at inside of the insertion recessed portion.

Meanwhile, it is not so much preferable to expose a shell made of a metal formed by normally sheet metal drawing to outside in view of its appearance. Further, there is a concern that a foreign matter is brought into touch with the exposed shell and noise is generated.

SUMMARY OF THE INVENTION

The present invention has been carried out in view of the above-described problem and it is an object of the invention to provide a modular jack excellent in appearance and electromagnetic shielding performance.

In order to achieve the above-described object, according to the first object of the invention, there is provided a modular jack characterized in including a casing having an insulating performance and having an insertion recessed portion for a modular plug opened in a front direction; a shell made of a metal for electromagnetic shielding including a front plate covering a front face of the casing and partitioning an insertion opening for the modular plug communicating with the insertion recessed portion at the front plate; and an insulating cover including a front plate covering the front plate of the shell and partitioning an insertion opening for the modular plug communicating with the insertion recessed portion at the front plate, wherein the insertion opening of the insulating cover is made smaller than the insertion opening of the shell such that an edge portion of the insertion opening of the shell is prevented from being exposed by an edge portion of the insertion opening of the insulating cover.

According to the invention, in a state in which the edge portion of the insertion opening of the front plate of the shell is not exposed, the front plate of the shell is covered by the insulating cover and therefore, the appearance is excellent. Further, a foreign matter is prevented from being brought into contact with the shell and electromagnetic shielding is ensured.

According to the second aspect of the invention, there is provided the modular jack according to the first aspect, characterized in that the shell further includes side walls extended from the front plate and provided along corresponding side walls of the casing and the insulating cover further includes side walls extended from the front plate and provided along the corresponding side walls of the shell. In this case, a range of covering the shell by the insulating cover can be widened and therefore, a foreign matter can be prevented from being brought into contact with the shell further firmly.

According to the third aspect of the invention, there is provided the modular jack according to the second aspect, characterized in that the corresponding side walls of the shell and the insulating cover are unitarily locked by locking portions provided at the corresponding side walls of the casing. In this case, the structure can be simplified and the fabrication cost can be made inexpensive.

DETAILED DESCRIPTION OF THE PREFERRED EMBODIMENTS

An explanation will be given of preferable embodiments of the invention in reference to the attached drawings.

Figure 1:
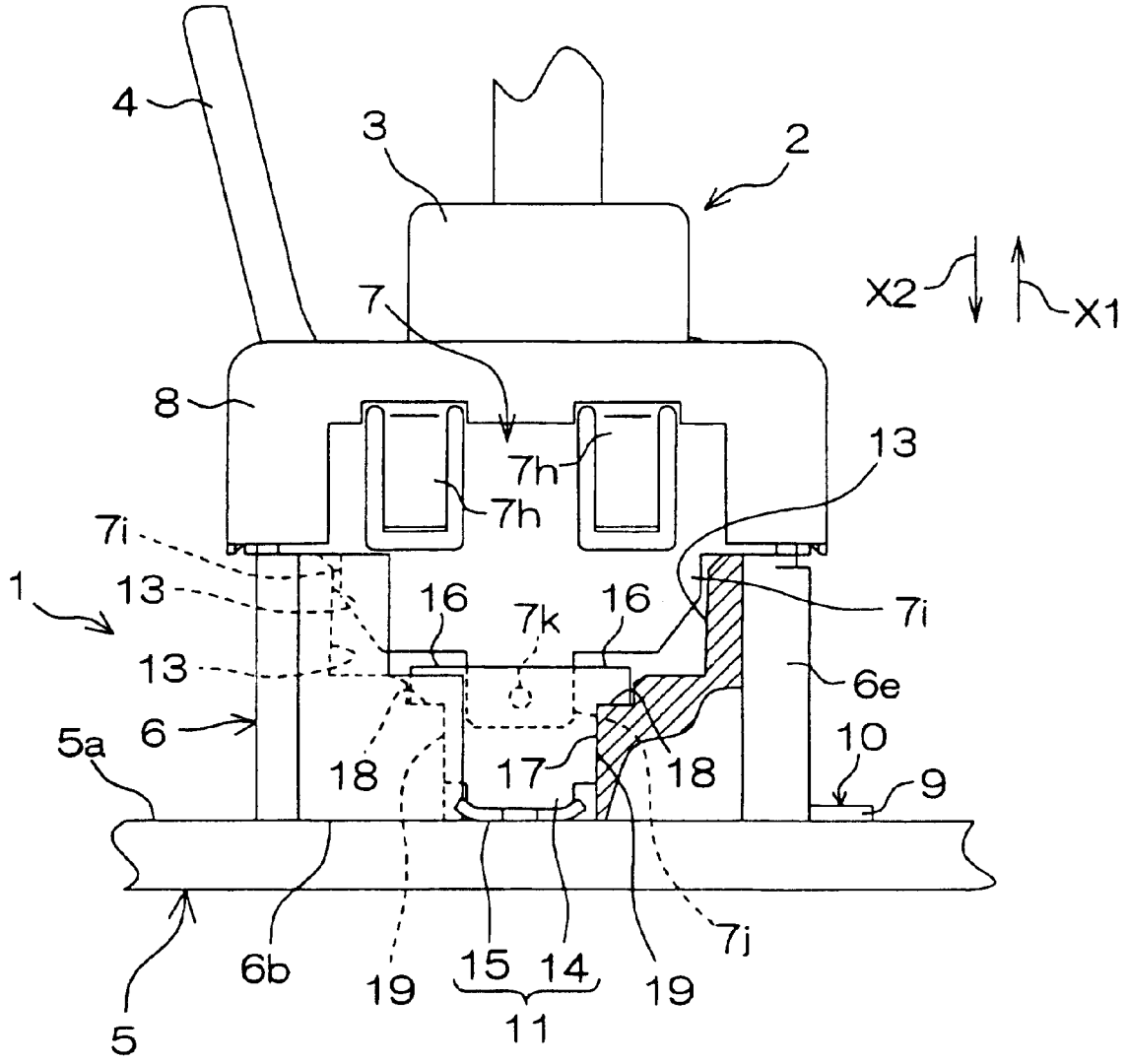
FIG. 1 is a partially broken side view showing a state of attaching a modular plug to a modular jack according to an embodiment of the invention.

FIG. 1 is an outline side view showing a state in which a modular plug is mounted to a modular jack according to an embodiment of the invention. In reference to FIG. 1, the modular jack 1 is for connecting a modular plug 2 of a standardized product. The modular plug 2 is provided with a plug main body 3 for holding a plurality of contact pins (not illustrated) and an elastically deformable engaging lever 4 supported by the plug main body 3 in a cantilever shape.

Although according to the embodiment, an explanation will be given in conformity to an example of a vertical modular jack in which a front side of the modular jack 1 constitutes an upper direction X1 and a rear side thereof constitutes a lower direction X2, the invention is not limited thereto but the invention may be applied to a horizontal modular jack in which a front side of the modular jack is directed in a horizontal direction.

The modular jack 1 is provided with a casing 6 having an insulating performance made of, for example, synthetic resin and arranged above a printed wiring board 5; a shell 7 made of a metal for electromagnetic shielding for covering at least a portion of the casing 6; an insulating cover 8 made of, for example, synthetic resin for covering at least a portion of the shell 7; a plurality of contact pins 10 respectively having lead portions 9; and a reinforcement tab 11 soldered to a conductive portion above the printed wiring board 5 while reinforcing the casing 6.

In a case where the insulating cover 8 is made of synthetic resin, the insulating cover 8 can be colored in order to let a user easily distinguish a position to connect or to make the color same as one of an apparatus such as a notebook type personal computer, a game machine or the like.

Figure 2:
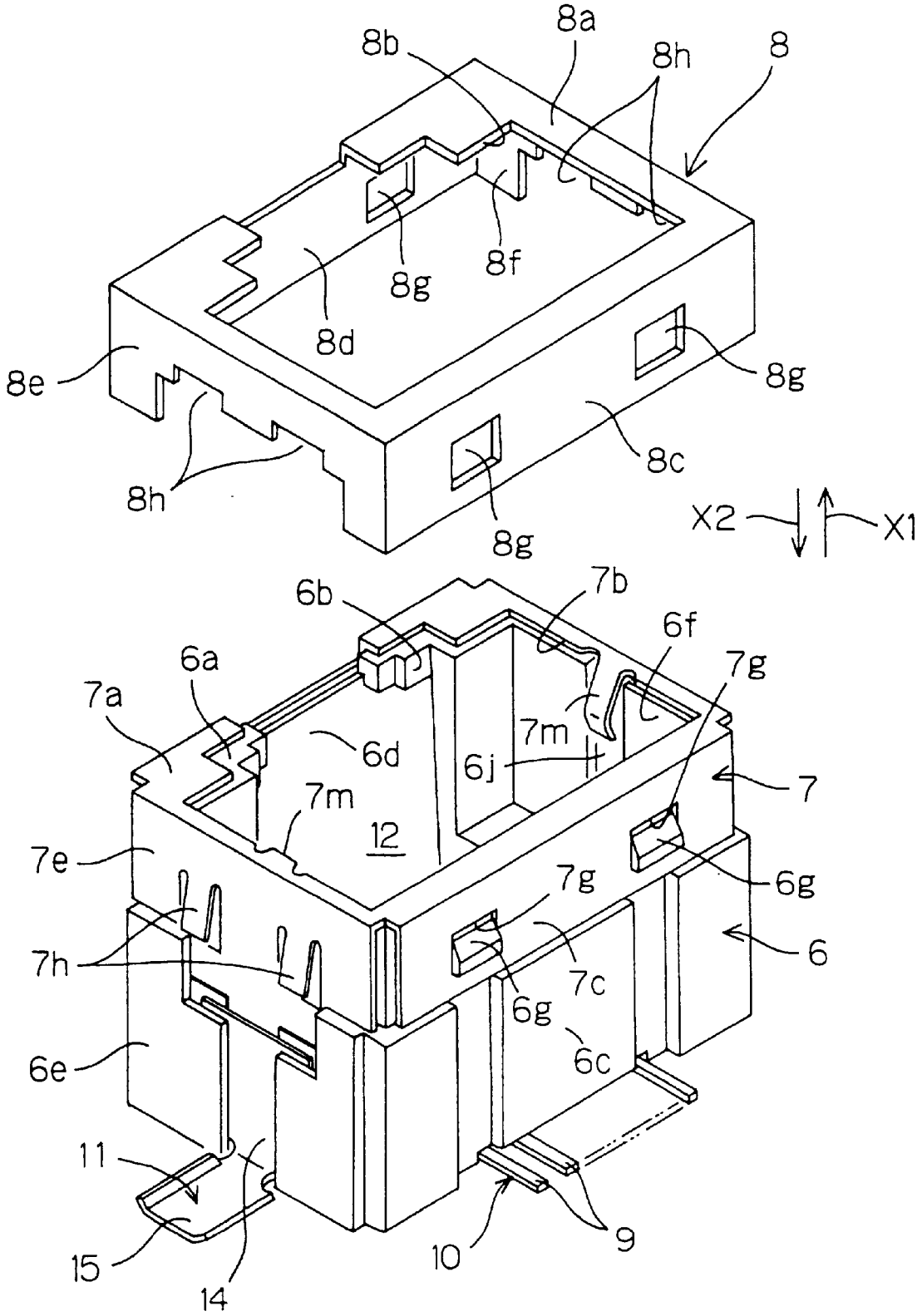
FIG. 2 is a disassembled perspective view of the modular jack.
Figure 3:
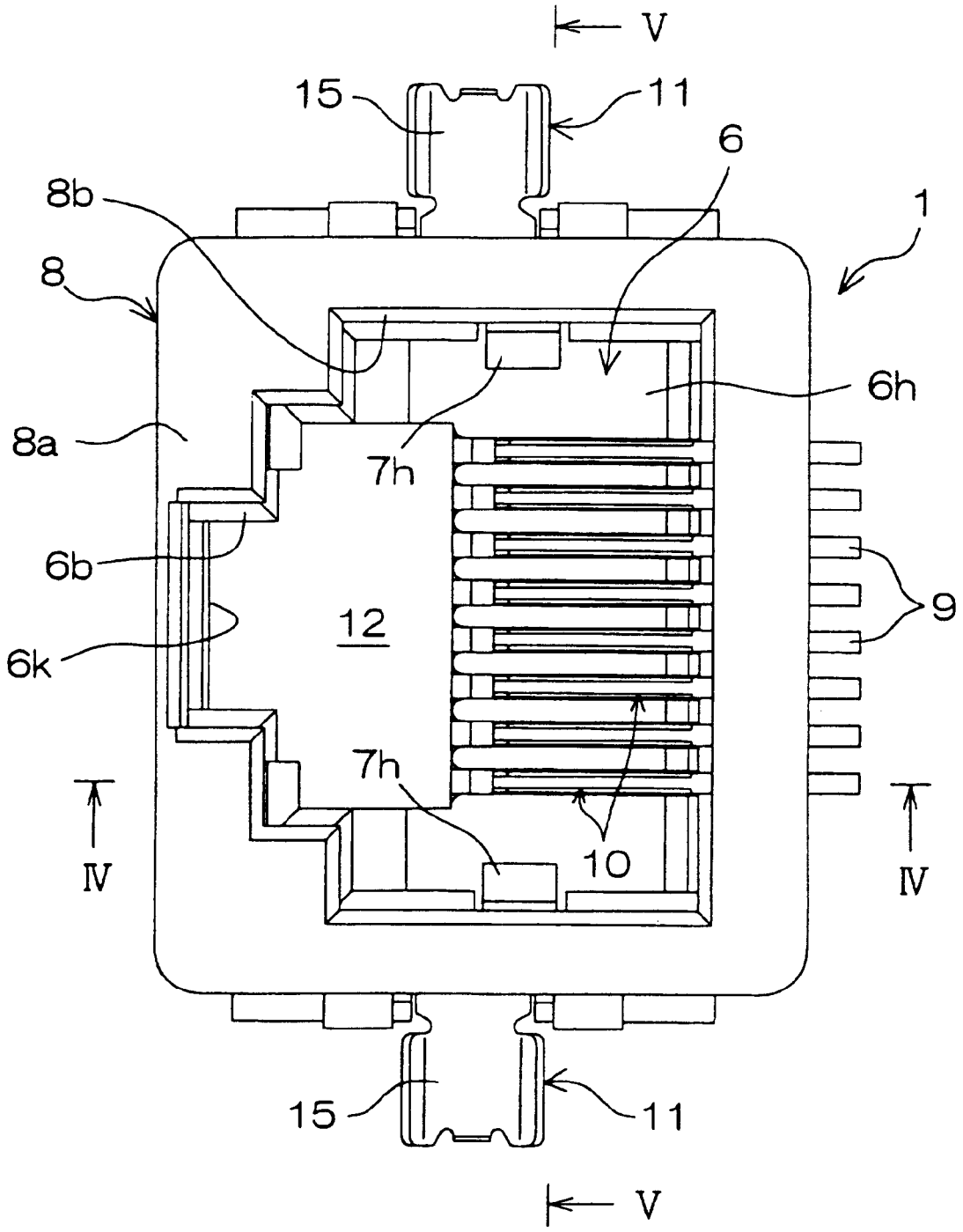
FIG. 3 is a plane view of the modular jack.
Figure 4:
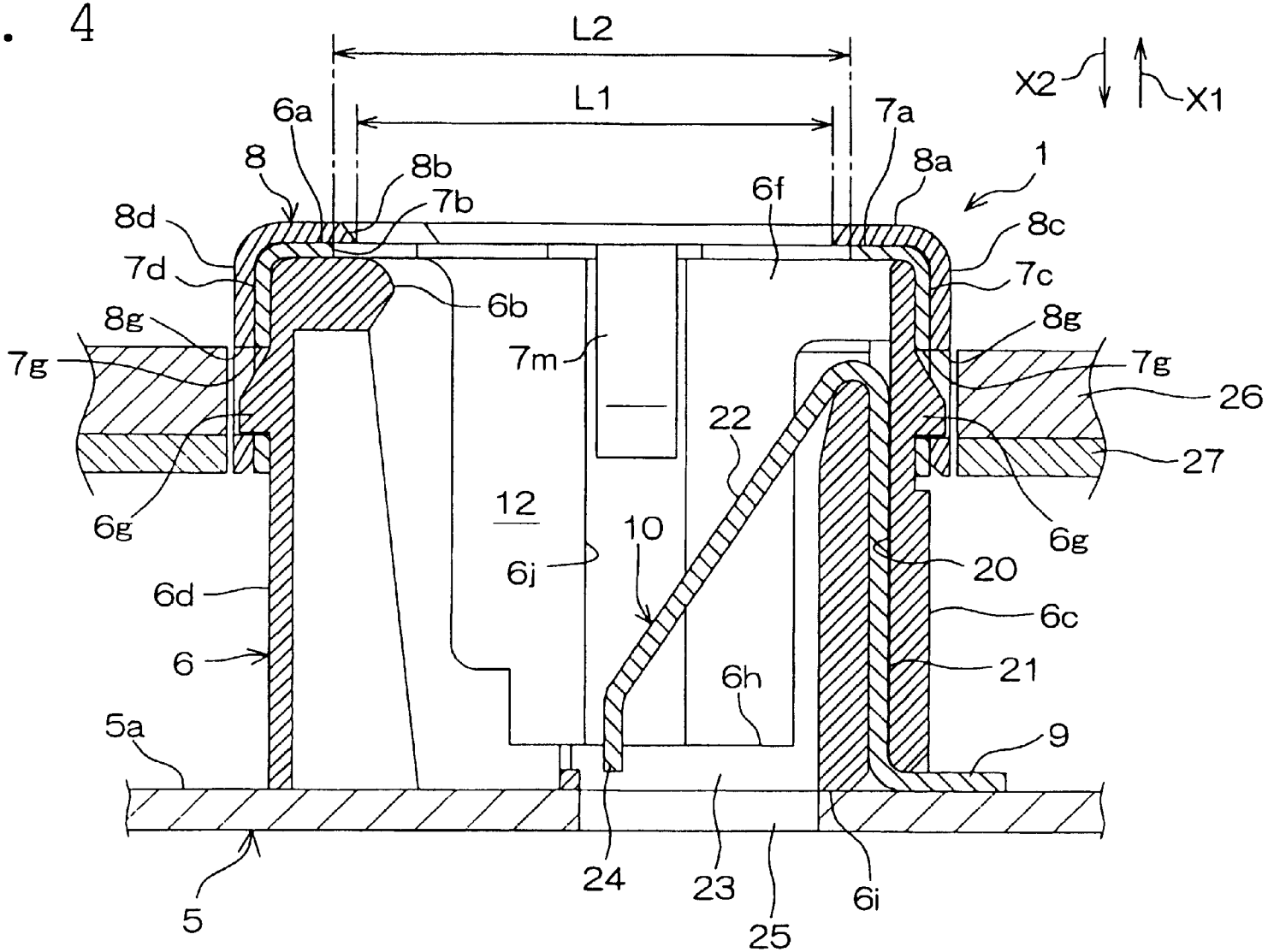
FIG. 4 is a sectional view taken along a line IV—IV of FIG. 3.
Figure 5:
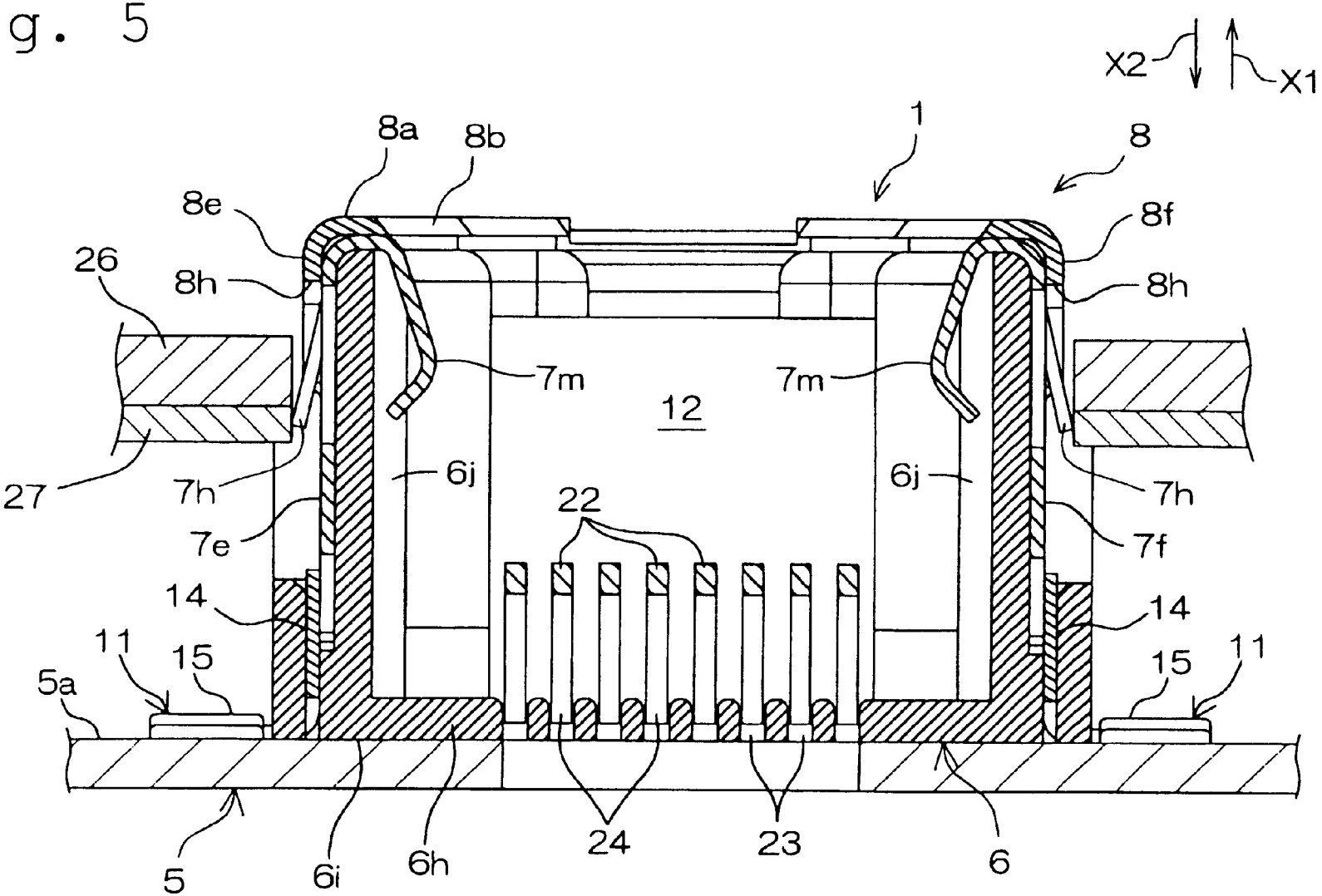
FIG. 5 is a sectional view taken along a line V—V of FIG. 3.
Figure 6:
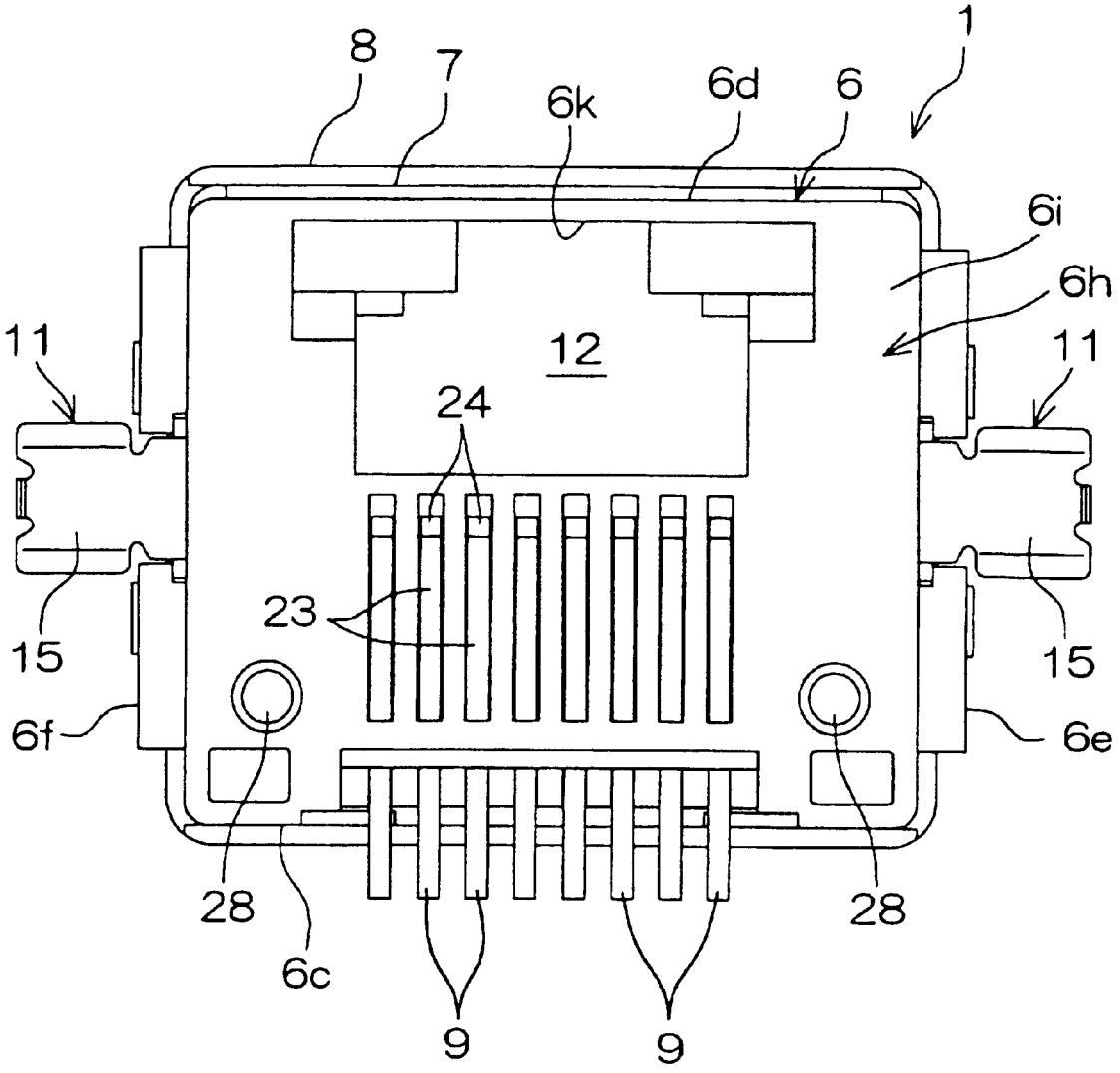
FIG. 6 is a rear view of the modular jack.

FIG. 2 is a disassembled perspective view of the modular jack, FIG. 3 is a plane view of the modular jack, FIG. 4 is a sectional view taken along a line IV—IV of FIG. 3, FIG. 5 is a sectional view taken along a ling V—V of FIG. 3, and FIG. 6 is a rear view of the modular jack.

In reference to FIG. 4, a main characteristic of the embodiment resides in that an edge portion of the insertion opening 7*b* of the shell 7 is prevented from being exposed by an edge portion of the insertion opening 8*b* of the insulating cover 8 with making an insertion opening 8*b* of the insulating cover 8 smaller than an insertion opening 7*b* of the shell 7 (That is, an opening diameter L1 of the insertion opening 8*b* is made smaller than an opening diameter L2 of the insertion opening 7*b*. L1<L2).

In reference to FIG. 2, FIG. 4 and FIG. 5, the casing 6 is provided with an insertion recessed portion 12 opened in the upper direction X1 via an insertion opening 6*b* formed at a front face 6*a* thereof, and the modular plug 2 is inserted into the insertion recessed portion 12 to thereby connect thereto electrically and mechanically. In reference to FIG. 4 and FIG. 6, a rear face 6*i* of the casing 6 constitutes an attaching face opposed to a surface 5*a* of the printed wiring board 5.

Figure 8:
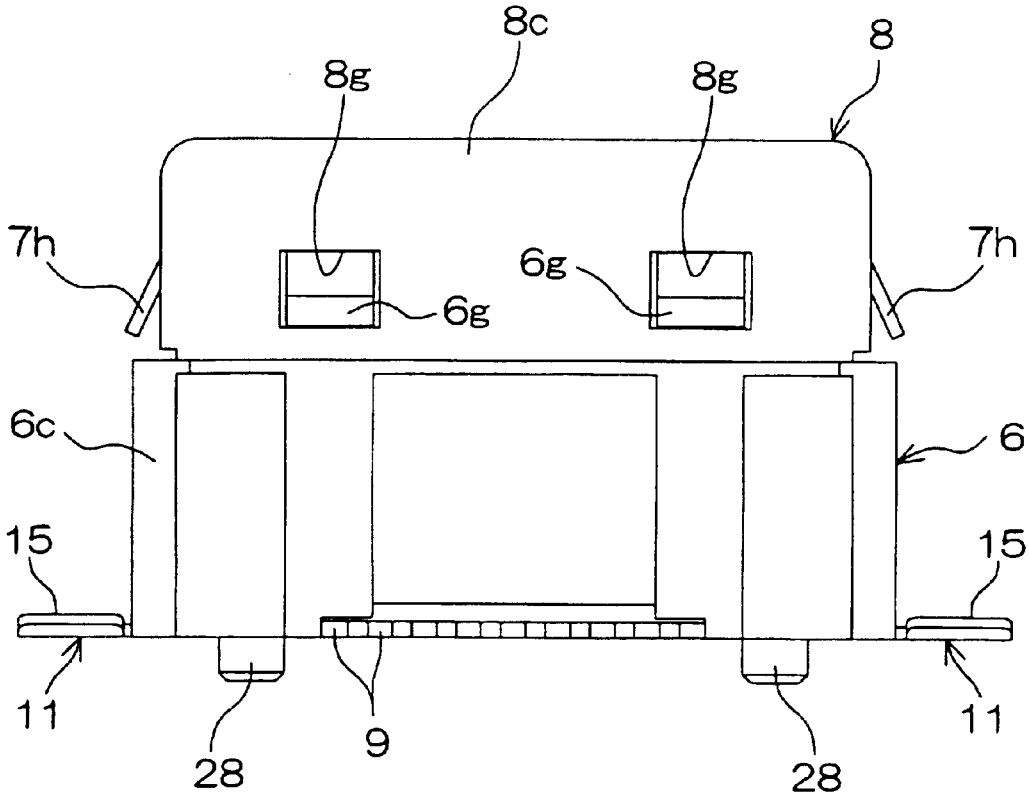
FIG. 8 is a side view of the modular jack.

In reference to FIG. 6, the rear face 6*i* of the case 6 is formed with an opening portion 6*k*. The opening portion 6*k* permits to introduce a base end portion (not illustrated) of the engaging lever 4 of the module plug 2 disposed at a mostly push-in position at inside of the insertion recessed portion 12 of the modular jack 1 to thereby minimize a depth dimension of the modular jack 1 and contribute to low back formation. In reference to FIG. 6 and FIG. 8, numeral 28 designates a rib inserted into an insertion hole (not illustrated) formed at the printed wiring board 5 for positioning the casing 6 to the printed wiring board 5.

In reference to FIG. 2 through FIG. 5, the shell 7 includes a front plate 7*a* having a rectangular contour for covering the front face 6*a* of the casing 6, and the insertion opening 7*b* for the modular plug communicating with the insertion recess portion 12 is partitioned at the front plate 7*a*. Side walls 7*c*, 7*d*, 7*e* and 7*f* respectively provided along corresponding side walls 6*c*, 6*d*, 6*e* and 6*f* of the casing 6, are extended from four sides of the front plate 7*a*. Further, elastic contact pieces 7*m* constituting a mountain shape, are respectively extended from a pair of opposed edge portions of the insertion opening 7*b* toward inside of the insertion recessed portion 12. In reference to FIG. 2 and FIG. 5, guide grooves 6*j* having a long vertical length for guiding the corresponding elastic contact pieces 7*m*, are formed at inner faces of the side walls 6*e* and 6*f* of the casing 6 (In FIG. 2, only the guide groove 6*j* of the side wall 6*f* is shown.). The respective elastic contact pieces 7*m* are for connecting to a metal shell (not illustrated) of the modular plug 2 to thereby connect to the ground. The shell is totally formed of sheet metal.

In reference to FIG. 2 and FIG. 4, left and right pairs of engaging holes 7*g* constituting, for example, a rectangular shape, are formed at the opposed side walls 7*c* and 7*d* of the shell 7. As shown by FIG. 2, the shell 7 is mounted to the casing 6 to cover the casing 6 from the upper side in the lower direction X2 and at this occasion, as shown by FIG. 4, the shell 7 is locked to the casing 6 by engaging locking projections 6*g* formed at the corresponding side walls 6*c* and 6*d* of the casing 6, with the respective engaging holes 7*g*.

In reference to FIG. 2 and FIG. 5, left and right pairs of window portions are formed at the opposed side walls 7*e* and 7*f* of the shell 7, and elastic contact pieces 7*h* are cut to rise in the respective window portions (in FIG. 2, only the elastic contact pieces 7*h* of the side wall 7*e* are shown) . As shown by FIG. 5, the elastic contact piece 7*h* is brought into elastic contact with a chassis 27 made of a metal provided along a rear face of a cabinet 26 made of synthetic resin of an apparatus for operating to electrically conduct the shell 7 with the chassis 27 and match the ground level.

In reference to FIG. 1, there are formed first extended portions 7*i* extended from central portions of the respective side walls 7*e* and 7*f* in the lower direction X2 (side of the printed wiring board 5) and there are further formed second extended portions 7*j* extended from central portions of the first extended portions 7*i* in the lower direction X2.

A pair of side portions of the first extended portions 7*i* are respectively fitted to a pair of groove portions 13 formed at the side walls 6*e* and 6*f* of the casing 6 to respectively open in the upward direction X1 and in inward side directions. The second extended portions 7*j* are fitted to groove portions 17 formed between side plates 14 of the corresponding reinforcement tabs 11 and the corresponding side walls 6*e* and 6*f* of the casing 6.

Figure 9:
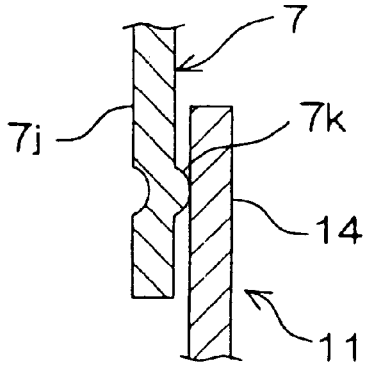
FIG. 9 is a sectional view of a side wall of a shell and a side plate of a reinforcement tab engaged with each other.

In reference to FIG. 1 and FIG. 9, an outer side face of the second extended portion 7*j*, is formed with an engaging projection 7*k* engaged with a back face of the side plate 14 of the reinforcement tab 11.

In reference to FIG. 1, the reinforcement tab 11 is constituted by pressing a conductive sheet metal member and is provided with the side plate 14 and a leg portion 15 in a plate-like shape extended outwardly and orthogonally to a lower end of the side plate 14. Arm portions 16 are extended from upper portions of a pair of side portions of the side plate 14 to both sides, thereby, the side plate 14 is constituted substantially by a T-like shape.

According to the respective reinforcement tabs 11, the side plates 14 are fitted to the pair of groove portions 17 of the corresponding side walls 6*e* and 6*f* by moving the side plates 14 from the upper side in the lower direction X2 along central portions of the side walls 6*e* and 6*f* of the shell 7 previously mounted to the casing 6. At this time, the arm portions 16 of the side plate 14 are brought into contact with positioning stepped portions 18 in the groove portion 17 to thereby position a height position of the reinforcement tab 11. Press-fitting projections 19 are formed at side edges downward from the respective arm portions 16 of the side plate 14. The respective press-fitting projections 19 are press-fitted to corresponding groove walls of the groove portion 17 to thereby lock the side plate 14 from being drawn in the upper direction X1. As shown by FIG. 9, the engaging rejection 7*k* of the shell 7 is brought into press contact with the side plate 14 of the reinforcement tab 11 prevented from drawing in this way to thereby ensure to prevent the shell 7 from being drawn in the upward direction.

In reference to FIG. 3 and FIG. 4, the side wall 6*c* holds the plurality of contact pins 10 to align horizontally. Specifically, each of the contact pins 10 is provided with a fixed portion 21 fixedly inserted to a fixing hole 20 penetrating the side wall 6*c* in the up and down direction, an elastic contact portion 22 in a cantilever shape bent to constitute an acute angle from an upper end of the fixed portion 21 and extended in an inclined shape toward the side of the printed wiring board 5 on the lower side and the lead portion 9 bent to constitute substantially right angle from a lower end of the fixed portion 21 and projected to an outer side of the side wall 6*c* along the surface 5*a* of the printed wiring board 5.

Meanwhile, as shown by FIG. 4, FIG. 5 and FIG. 6, at a rear wall 6*h* forming a rear face 6*i* of the casing 6, there are formed a plurality of slits 23 in parallel with each other as lead-out openings for opening the insertion recessed portion 12 to the side of the printed wiring board 5 on the rear side. The slits 23 as the lead-out openings are slidably fitted with front ends 24 of the corresponding elastic contact portions 22.

Figure 7:
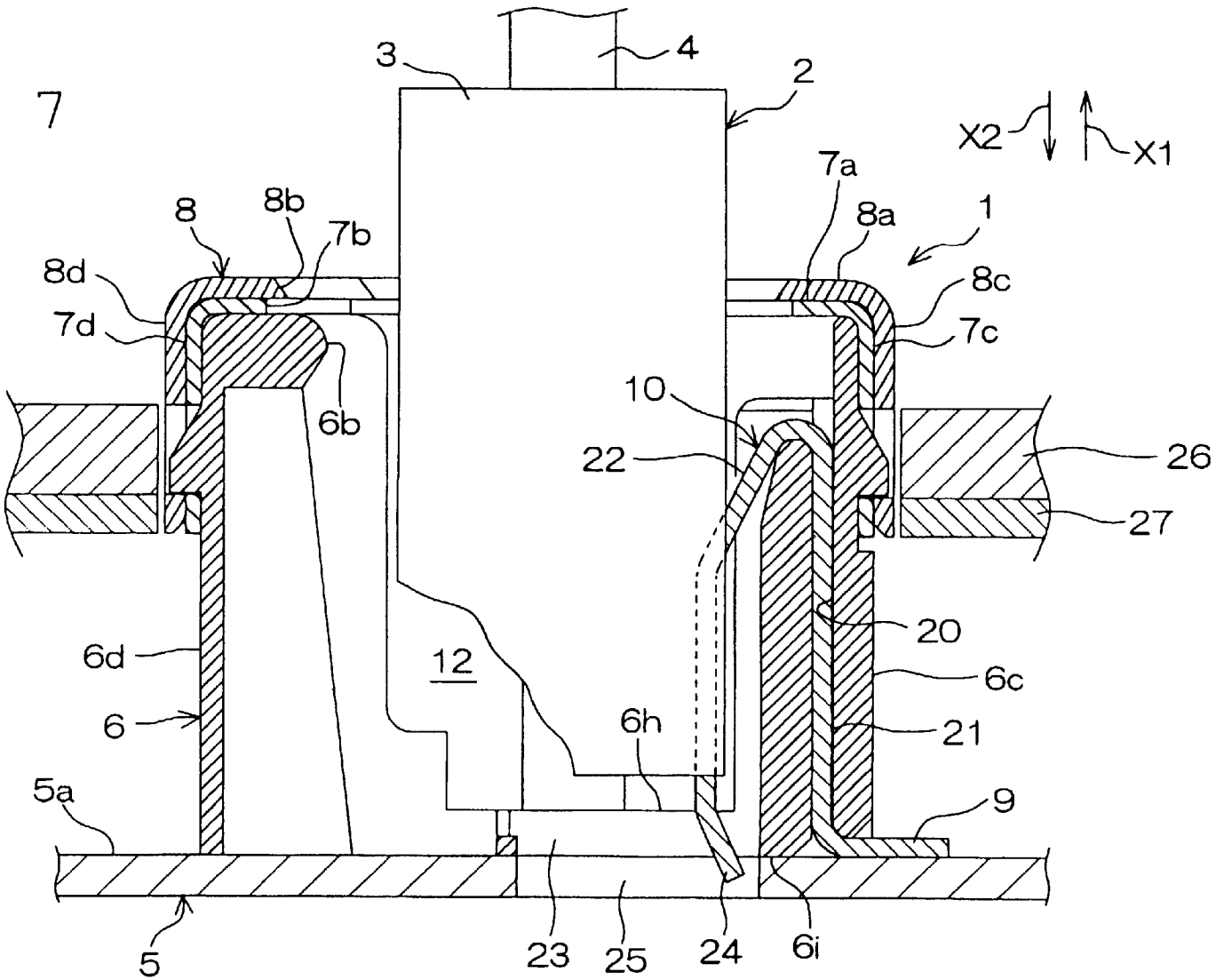
FIG. 7 is an outline sectional view of the modular jack in a state of being connected to the modular plug.

As shown by FIG. 7, when the modular jack 1 is connected with the modular plug 2 and the respective elastic contact portions 22 are bent, the front ends 24 of the elastic contact portions 22 are projected to the rear side of the casing 6 via the slits 23. The printed wiring board 5 is formed with through holes 25 substantially in a rectangular shape as escapement for permitting the front ends 24 of the plurality of the elastic contact portions 22 to project to the rear side of the casing 6. The slits 23 guide the front ends 24 of the elastic contact portions 22 to smoothly dislocate when the front ends 24 of the elastic contact portions 22 are deformed to bend.

In reference to FIG. 2 through FIG. 5, the insulating cover 8 is provided with a front plate 8*a* having the insertion opening 8b and having substantially a rectangular contour and four side walls 8*c*, 8*d*, 8*e* and 8*f* extended from four sides of the front plate 8*a* and constituting a square ring shape.

In reference to FIG. 4, the insertion opening 8*b* of the insulating cover 8 is formed by a similar shape slightly smaller than the insertion opening 7*b* of the shell 7 (opening diameter L1<L2), as a result, the edge portion of the insertion opening 7*b* of the shell 7 is prevented from being exposed by the edge portion of the insertion opening 8*b* of the insulating cover 8.

The respective side walls 8*c* through 8*f* of the insulating cover 8 are made to cover the corresponding side walls 7*c* through 7*f* of the shell 7. Ranges of the respective side walls 8*c* through 8*f* of the insulating cover 8 of covering the corresponding side walls 7*c* through 7*f* of the shell 7, correspond to ranges of exposing the shell 7 from the cabinet 26 of the apparatus in a state in which the modular jack 1 is actually attached to the apparatus as shown by FIG. 4 and FIG. 5.

In reference to FIG. 2 and FIG. 5, the side walls 8*e* and 8*f* are formed with cutout portions 8*h* as escapement for preventing interference with the respective elastic contact pieces 7*h* of the shell 7.

Meanwhile, in reference to FIG. 2 and FIG. 4, the side walls 8*c* and 8*d* are formed with respective pairs of engaging holes 8*g* for engaging with the locking projections 6*g* of the casing 6 projected from the engaging holes 7*g* of the shell 7. By the engagement, there is achieved to prevent the insulating cover 8 from drawing from the shell 7. The locking projections 6*g* of the casing 6 achieve to unitarily lock the shell 7 and the insulating cover 8 to thereby achieve to prevent from being drawn, and the structure can be simplified.

As described above, according to the embodiment, in the state in which the edge portion of the insertion opening 7*b* of the front plate 7*a* of the shell 7 is not exposed, the front plate 7*a* of the shell 7 is covered by the front plate 8*a* of the insulating cover 8, and accordingly, its appearance is excellent. Further, a foreign matter is prevented from being brought into contact with the front plate 7*a* of the shell 7, and electromagnetic shielding is ensured.

Particularly, portions of covering the shell 7 are widened by the side walls 8*c* through 8*f* of the insulating cover 8, in the state that the modular jack 1 is attached, portions of the shell 7 actually exposed from the cabinet 26 of the apparatus can be covered and therefore, a foreign matter can be prevented from being brought into contact with the shell 7 further firmly, and its appearance is excellent.

Figure 10:
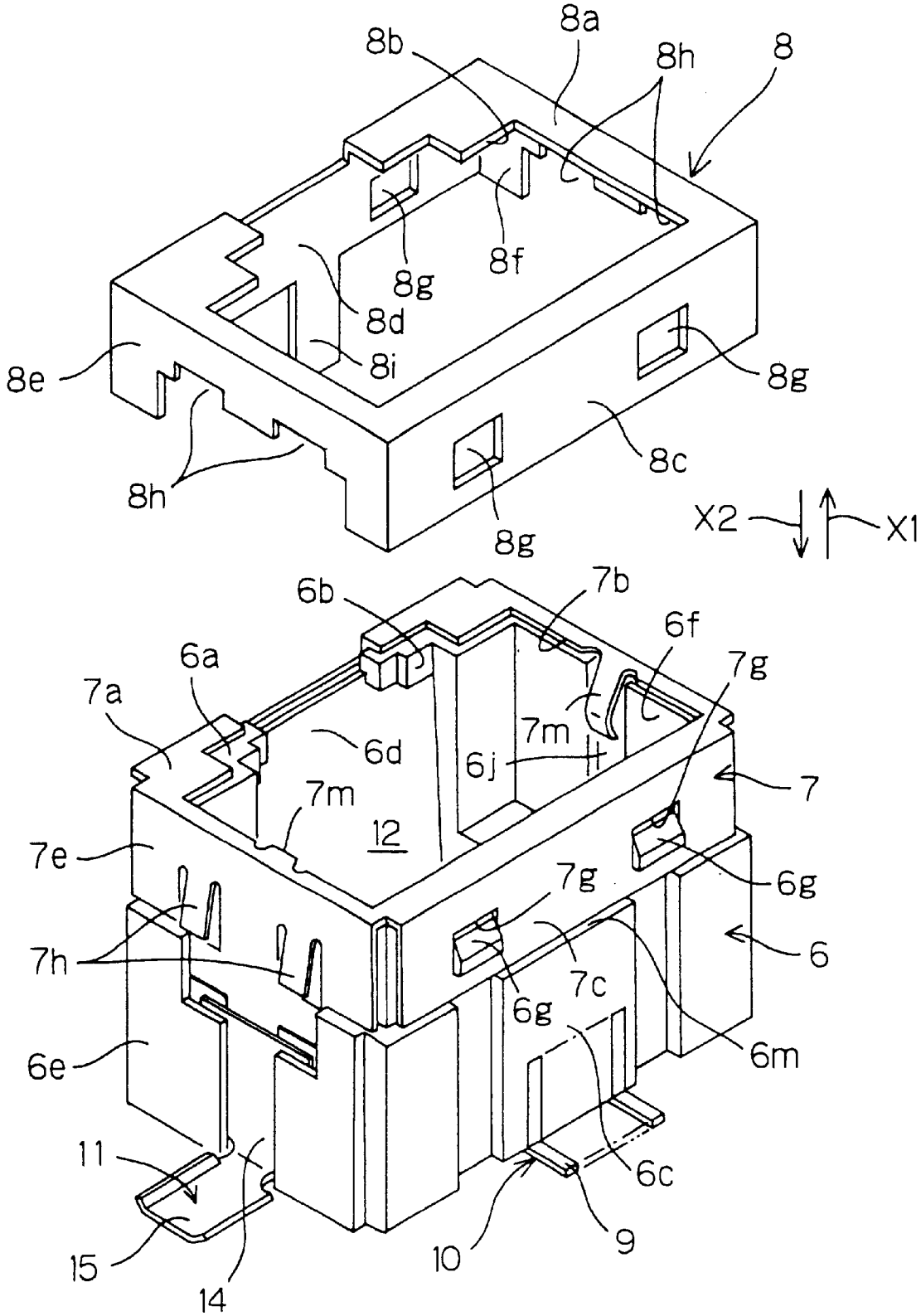
FIG. 10 is a disassembled perspective view of a modular jack according to another embodiment of the invention.

Further, the invention is not limited to the above-described embodiment but, for example, as shown by FIG. 10, an inverse insertion preventive portion 8*i* extended in the lower direction may be extended from the side wall 8*d* of the insulating cover 8. In this case, when the direction of the insulating cover 8 is assumedly changed from a regular direction by 180 degrees and the side wall 8*d* of the insulating cover is going to cover the side wall 7*c* of the shell 7, a lower end of the inverse insertion preventive portion 8*i* is brought into contact with a stepped portion 6*m* of the side wall 6*c* of the casing 6. Thereby, mounting of the insulating cover 8 is hampered and therefore, assembly by so-to-speak inverse insertion cannot be carried out. In the embodiment of FIG. 10, constitutions similar to those of FIG. 2 are attached with similar notations and an explanation thereof is omitted.

Figure 11:
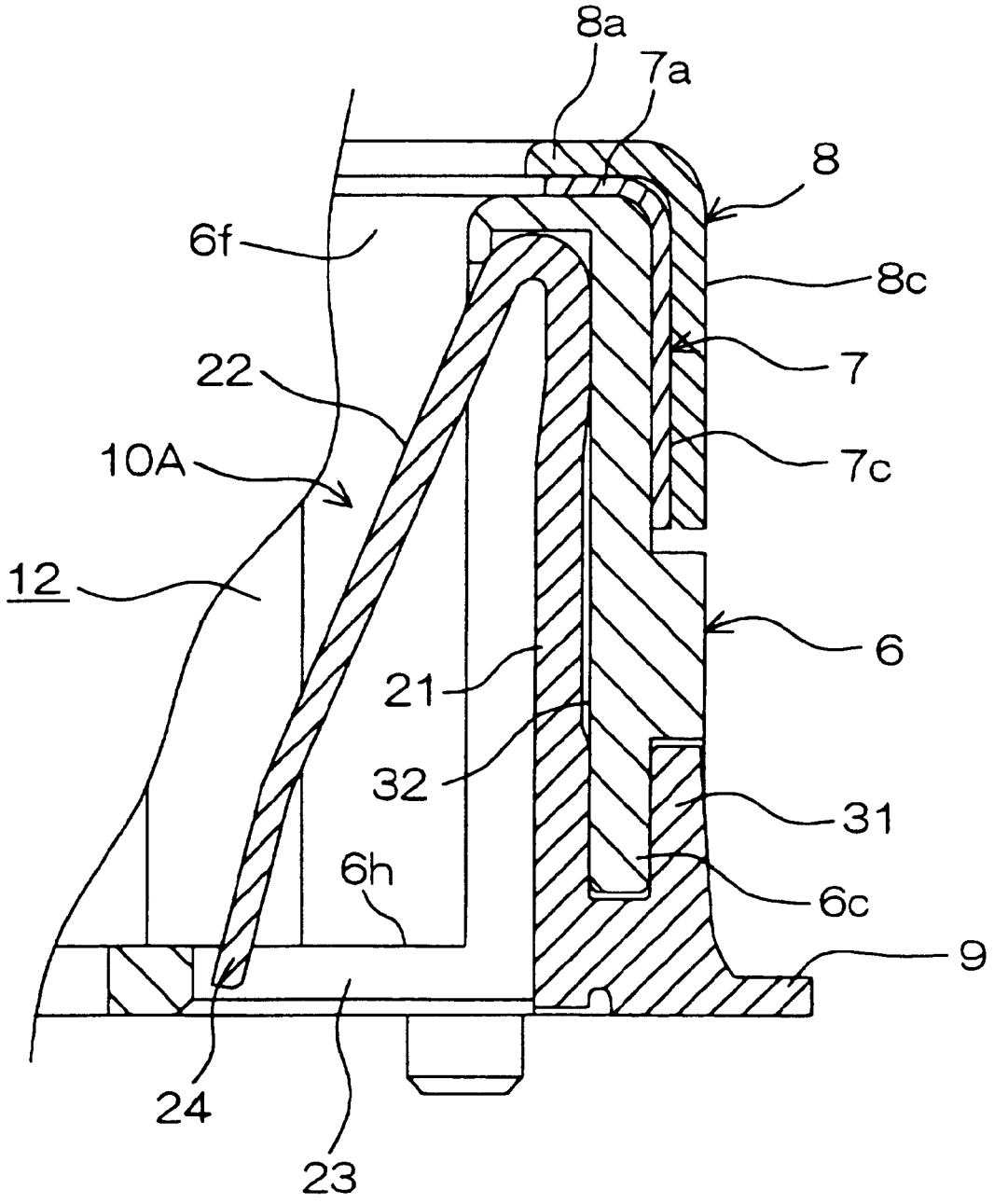
FIG. 11 is a sectional view of a modular jack according to still another embodiment of the invention.

Further, as shown by FIG. 11, there may be constructed a structure in which there is provided an attached piece 31 extended from a lead 9 of a contact pin 10A in parallel with the fixed portion 21 and a lower portion of the side wall 6*c* is sandwiched by the fixed portion 21 and the attached piece 31 to thereby fix the contact pin 10A to the casing 6. Although according to the embodiment of FIG. 4, the fixed portion 21 is inserted into the fixing hole 20 of the casing 6, in this embodiment, the fixed portion 21 is mounted to a holding groove 32 opened to inside of the casing 6 and the lower side of the casing 6. The holding groove 32 communicates with the slit 23. In this embodiment, assembling can easily be carried out by mounting the contact pin 10A from the lower side of the casing 6. That is, the elastic contact portion 22 and the fixed portion 21 of the contact pin 10A are inserted into the casing 6 via the slit 23, and the lower portion of the side wall 6*c* of the casing 6 is press-fitted into a space between the fixed portion 21 and the attached piece 31 to thereby fix thereto. In the embodiment of FIG. 11, constitutions similar to those of the embodiment of FIG. 4 are attached with similar notations.

Further, the modular jack 1 may be laid out relative to the apparatus such that the front plate 8*a* of the insulating cover 8 and the cabinet 26 of the apparatus are made to be flush with each other. Otherwise, various changes can be carried out within the range of the invention.

What is claimed is:

1. A modular jack comprising:

a casing having an insulating performance and having an insertion recessed portion for a modular plug opened in a front direction;

a shell made of metal for electromagnetic shielding including a front plate covering a front face of the casing and partitioning an insertion opening for the modular plug communicating with said insertion recessed portion; and an insulating cover including a front plate covering the front plate of the shell and partitioning an insertion opening for the modular plug communicating with the insertion recessed portion, wherein the insertion opening of the insulating cover is made smaller than the insertion opening of the shell such that an edge portion of the insertion opening of the shell is prevented from being exposed by an edge portion of the insertion opening of the insulating cover, and wherein the shell further includes side walls extended from the front plate and provided along corresponding side walls of the casing, and the insulating cover further includes side walls extended from the front plate and provided along the corresponding side walls of the shell.

2. The modular jack according to claim 1, wherein the corresponding side walls of the shell and the insulating cover are unitarily locked by locking portions provided at the corresponding side walls of the casing.

3. The modular jack according to claim 1, wherein one of the side wall of the insulating cover includes an inverse insertion preventive portion extended in the lower direction.

4. A modular jack comprising:

a casing having an insulating performance and having an insertion recessed portion for a modular plug opened in a front direction;

a shell made of metal for electromagnetic shielding including a front plate covering a front face of the casing and partitioning an insertion opening for the modular plug communicating with said insertion recessed portion; and an insulating cover including a front plate covering the front plate of the shell and partitioning an insertion opening for the modular plug communicating with the insertion recessed portion, wherein the insertion opening of the insulating cover is made smaller than the insertion opening of the shell such that an edge portion of the insertion opening of the shell is prevented from being exposed by an edge portion of the insertion opening of the insulating cover, and wherein the insulating cover further includes an inverse insertion preventive portion extending in a lower direction from a side wall of the insulating cover and configured to contact a stepped portion of a side wall of the casing so as to prevent an improper mounting of the insulating cover on the casing.

5. The modular jack according to claim 4, wherein the shell further includes side walls extended from the front plate and provided along corresponding side walls of the casing, and the insulating cover further includes side walls extended from the front plate and provided along the corresponding side walls of the shell.

6. The modular jack according to claim 5, wherein the corresponding side walls of the shell and the insulating cover are unitarily locked by locking portions provided at the corresponding side walls of the casing.

* * * * *